US012484678B2

(12) United States Patent
Yao et al.

(10) Patent No.: US 12,484,678 B2
(45) Date of Patent: Dec. 2, 2025

(54) SMART HAIR DRYER ACCESSORY DETECTION

(71) Applicant: SharkNinja Operating LLC, Needham, MA (US)

(72) Inventors: Ming Yao, Suzhou (CN); Joshua Thomas Richards, Hassocks (GB); Jack Qin, Suzhou (CN); Terry Tan, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 1052 days.

(21) Appl. No.: 17/378,347

(22) Filed: Jul. 16, 2021

(65) Prior Publication Data

US 2022/0400827 A1 Dec. 22, 2022

Related U.S. Application Data

(63) Continuation of application No. PCT/CN2021/100384, filed on Jun. 16, 2021.

(51) Int. Cl.
*A45D 20/12* (2006.01)

(52) U.S. Cl.
CPC ..... *A45D 20/122* (2013.01)

(58) Field of Classification Search
None
See application file for complete search history.

(56) References Cited

U.S. PATENT DOCUMENTS

2004/0088878 A1* 5/2004 Langley
2011/0277335 A1 11/2011 Prehodka
(Continued)

FOREIGN PATENT DOCUMENTS

CN 109645651 A 4/2019
CN 110786617 A 2/2020
(Continued)

OTHER PUBLICATIONS

International Search Report And Written Opinion received for PCT Patent Application No. PCT/CN2021/100384, mailed on Mar. 15, 2022, 10 pages.
(Continued)

*Primary Examiner* — Jason Lau
(74) *Attorney, Agent, or Firm* — Mintz, Levin, Cohn, Ferris, Glovsky and Popeo, P.C. US

(57) ABSTRACT

Systems are provided for a hair dryer. A hair drying system can include a plurality of different types of accessories and a hair dryer having an output end configured to supply air. The output end can include an attachment assembly having a retaining mechanism configured to engage each of the plurality of different types of accessories to retain a selected one of the different types of accessories on the hair dryer, an alignment mechanism configured to align one of the accessories in a predetermined rotational orientation relative to the output end, and an accessory detection assembly configured to move to one of a plurality of predetermined structural configurations based on the type of accessory attached to the hair dryer. The hair dryer can further include a controller configured to control the supply of air through the output end in dependence on the predetermined structural configuration of the accessory detection assembly.

23 Claims, 12 Drawing Sheets

(56) References Cited

U.S. PATENT DOCUMENTS

| | | | |
|---|---|---|---|
| 2013/0025106 | A1* | 1/2013 | Hernandez-Laines |
| 2013/0133218 | A1 | 5/2013 | Hadden |
| 2014/0047727 | A1 | 2/2014 | Torres et al. |
| 2016/0353854 | A1 | 12/2016 | Thomas |
| 2020/0178667 | A1* | 6/2020 | Pang |

FOREIGN PATENT DOCUMENTS

| | | | | |
|---|---|---|---|---|
| GB | 2560736 | A | | 9/2018 |
| JP | S5433154 | A | * | 3/1979 |
| JP | 5199915 | B2 | | 5/2013 |
| JP | 2019146720 | A | | 9/2019 |
| JP | 2020062401 | A | | 4/2020 |
| JP | 2020522336 | A | | 7/2020 |
| WO | 2014087136 | A1 | | 6/2014 |

OTHER PUBLICATIONS

Extended European Search Report for Application No. EP 21901673.
0, mailed on Dec. 7, 2022, 4 pages.

* cited by examiner

SMART HAIR DRYER ACCESSORY DETECTION

CROSS-REFERENCE TO RELATED APPLICATIONS

This application is a continuation application of International Application No. PCT/CN/2021/100384, filed Jun. 16, 2021, and entitled "Smart Hair Dryer Accessory Detection," the contents of which are hereby incorporated by reference in their entirety.

FIELD

Devices, systems, and methods are provided for detecting a type of accessory attached to a hair dryer, and for operating a hair dryer based on the type of accessory detected.

BACKGROUND

Hair dryers provide a flow of air that a user can utilize to dry wet hair. In many instances, the hair dryer also heats and/or ionizes the air prior to the air exiting the hair dryer. Hair dryers generally include an outlet having an opening with fixed dimensions where the heated air is expelled from the device. The speed, direction, and type of airflow of the airflow exiting from the outlet can be altered by attaching a removable accessory to the hair dryer. It can be challenging to maintain desired operating parameters of a hair dryer when switching between different attachments since each attachment can affect the airflow leaving the outlet based on its configuration.

Accordingly, there is a need for improved devices, systems, and methods for detecting a type of accessory attached to a hair dryer and for controlling operational settings of the hair dryer based on the type of accessory detected.

SUMMARY

Hair dryers, hair dryer accessories, hair dry kits, and methods for using the same, are provided. In one embodiment, a hair drying system is provided that includes several different types of accessories and a hair dryer having an output end configured to supply air. The output end can include an attachment assembly having a retaining mechanism configured to selectively engage each of the different types of accessories to retain a selected one of the different types of accessories on the hair dryer. The hair dryer can also include an alignment mechanism configured to align at least one of the different types of accessories in at least one predetermined rotational orientation relative to the output end. The hair dryer can further include an accessory detection assembly configured to move to one of a plurality of predetermined structural configurations based on the type of accessory attached to the hair dryer. The hair dryer can further include a controller configured to control the supply of air through the output end in dependence on the predetermined structural configuration of the accessory detection assembly.

In one embodiment, at least one of the different types of accessories includes an alignment mechanism configured to interact with the rotational alignment mechanism on the hair dryer to align the at least one accessory in a predetermined rotational orientation relative to the output end. The hair dryer alignment mechanism can be in the form of at least one surface feature formed on a central hub of the hair dryer attachment assembly, and the accessory alignment mechanism comprises at least one complementary surface feature formed on an inner collar of the at least one of the different types of accessories. In an exemplary embodiment, the at least one predetermined rotational orientation can be only one predetermined rotational orientation, only two predetermined rotational orientations, or multiple rotational orientations.

In another embodiment, each of the different types of accessories can include an actuation mechanism configured to actuate the accessory detection assembly to position the accessory detection assembly in one of the predetermined structural configurations. The accessory detection assembly can include, for example, first and second push rods each having a predefined position for each of the predetermined structural configurations of the hair dryer attachment assembly. Each of different types of accessories can include an actuation mechanism such as a planar outer collar that allows the first and second push rods to remain in an initial position, a collar having protrusions configured to actuate only the first push rod, a collar having protrusions configured to actuate only the second push rod, and a collar having protrusions configured to actuate each of the first and second push rods.

In another embodiment, each of the different types of accessories can include an attachment assembly having a retaining groove configured for mating engagement with the retaining mechanism on the hair dryer. The retaining mechanism on the attachment assembly of the hair dryer can be in the form of at least one biased pin configured to engage the retaining groove.

In other aspects, movement of the attachment assembly between the predetermined structural configurations is configured to control an on/off position a switches, the switches having a unique combination of on/off positions that correspond to the type of accessory attached to the attachment assembly.

The hair dryer can include other features such as a memory in the housing storing a plurality of predetermined stored settings that each correspond to one of the different types of accessories, with each setting including an operating parameter for the air supply. The hair dryer can also include a processor in the housing communicatively coupled to the attachment assembly and the memory such that the processor is configured to determine the type of accessory based on the structural configuration of the hair dryer attachment assembly, and is configured to cause the air supply to operate based on the predetermined stored setting for the determined type of accessory.

In another embodiment, an accessory is provided for use with a hair dryer. The accessory can include a housing having a first end with an air inlet and a second end with an air outlet, and a collar assembly arranged at the first end and selectively matable with a hair dryer. The collar assembly can include an outer collar configured to cause an attachment assembly on a hair dryer to move to a first unique structural configuration that corresponds to a first operational setting of the hair dryer when the accessory is attached to the hair dryer, and an inner collar configured to align the accessory in at least one predetermined rotational orientation relative to a hair dryer when the accessory is attached to the hair dryer.

In one embodiment, the outer collar can include a first plurality of extrusions configured to interact with a plurality of switches in a hair dryer. The inner collar can include a plurality of tabs configured to align with complementary surface features on a hair dryer to control the rotational orientation of the accessory to the hair dryer when the accessory is attached to the hair dryer.

In another embodiment, an accessory kit is provided for use with a hair dryer and includes a first accessory having a first end with an air inlet and a second end with an air outlet. The first end can include a first attachment assembly having a first retaining groove configured to mate with an engagement mechanism on a hair dryer for mating the first accessory to a hair dryer, a first outer collar having a plurality of first protrusions formed thereon and configured to actuate an accessory detection assembly on a hair dryer, and a first inner collar having a first alignment mechanism configured to align the first accessory in at least one predetermined rotational orientation relative to a hair dryer. The kit can also include a second accessory having a first end with an air inlet and a second end with an air outlet. The first end can include a second attachment assembly having a second retaining groove configured to mate with an engagement mechanism on a hair dryer for mating the second accessory to a hair dryer, a second outer collar having a planar configured such that the second outer collar enables an accessory detection assembly on a hair dryer to remain in an initial position, and a second inner collar configured to mate with a hair dryer such that the second accessory is freely rotatable relative to the hair dryer.

In another embodiment, the kit can include a third accessory having a first end with an air inlet and a second end with an air outlet. The first end can include a third attachment assembly having a third retaining groove configured to mate with an engagement mechanism on a hair dryer for mating the third accessory to a hair dryer, a third outer collar having a plurality of third protrusions formed thereon and configured to actuate an accessory detection assembly on a hair dryer, the plurality of third protrusions differing from the plurality of first protrusions, and a third inner collar having a third alignment mechanism configured to align the third accessory in at least one predetermined rotational orientation relative to a hair dryer.

In other aspects, a hair dryer is provided having a handheld housing with an air inlet and an air outlet configured to supply heated air. An attachment assembly is located adjacent the outlet end and is configured to mate with different types of accessories. The attachment assembly can be configured to align an accessory attached thereto in a predetermined rotational orientation relative to the housing, and the attachment assembly can be movable between a plurality of predetermined positions based on the type of accessory attached thereto. The hair dryer can also include a motor arranged within the housing and configured to supply air through the air outlet based on a plurality of predetermined stored settings corresponding to the type of accessory attached to the attachment assembly.

In one embodiment, the attachment assembly includes an inner collar at the air outlet having at least one surface feature configured to interact with a corresponding surface feature on an accessory to align the accessory in a predetermined rotational orientation relative to the hair dryer. At least one surface feature on the inner collar can be configured to align an actuation mechanism on an accessory with the plurality of push rods. The attachment assembly can also include a plurality of push rods movable between the plurality of predetermined positions based on the type of accessory attached thereto.

The hair dryer can also include other features such as a memory in the housing storing the plurality of predetermined stored settings, and a processor configured to cause the hair dryer to automatically operate at one of plurality of predetermined stored settings based on the predetermined position of the attachment assembly.

BRIEF DESCRIPTION OF THE DRAWINGS

The present disclosure will be more fully understood from the following detailed description taken in conjunction with the accompanying drawings, in which.

DETAILED DESCRIPTION

Figure 1:
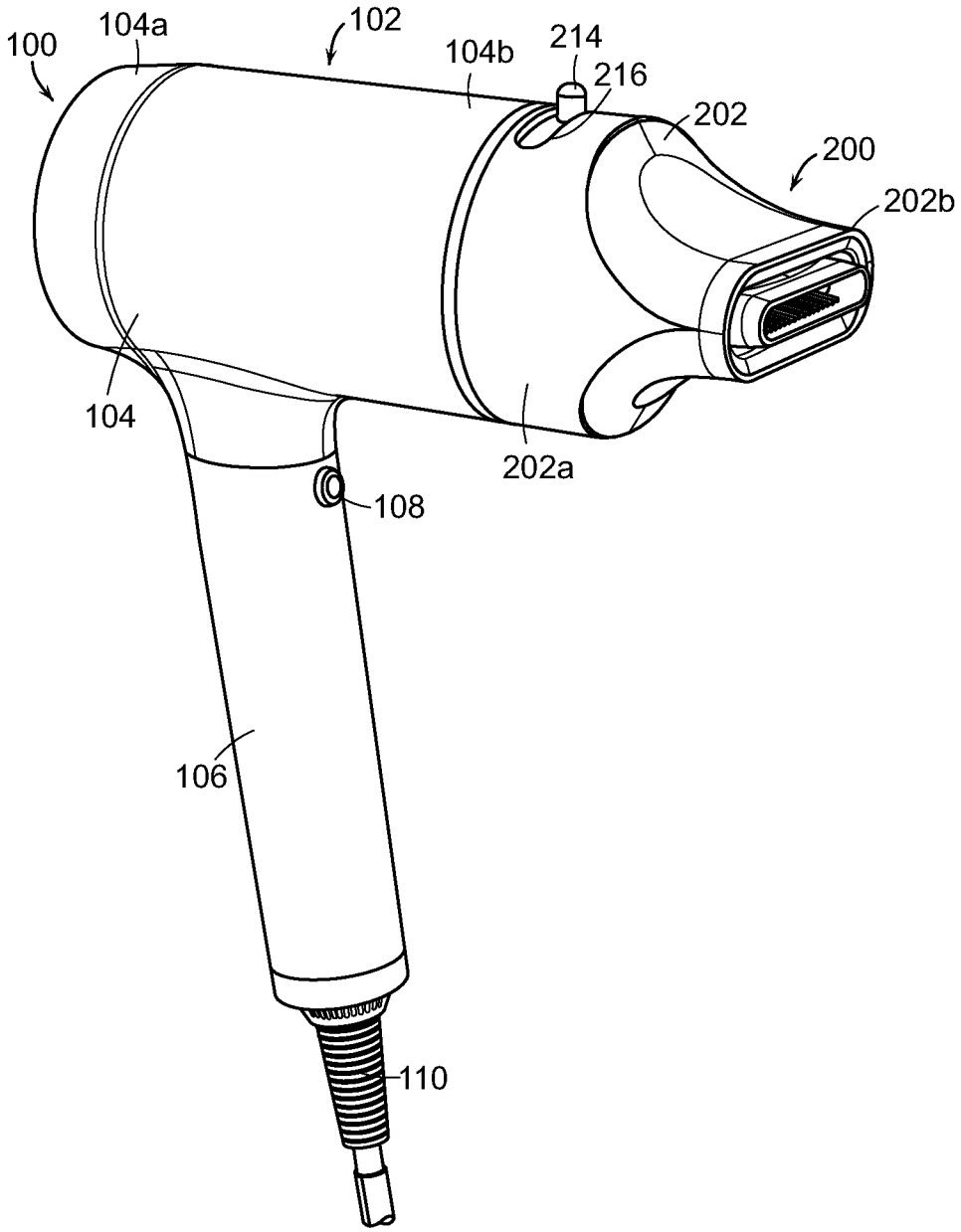
FIG. 1 is a side perspective view of one exemplary embodiment of a hair dryer system having a hair dryer with a concentrator accessory secured thereto.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Further, in the present disclosure, like-named components of the embodiments generally have similar features, and thus within a particular embodiment each feature of each like-named component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Sizes and shapes of the systems and devices, and the components thereof, can depend at least on the anatomy of the subject in which the systems and devices will be used, the size and shape of components with which the systems and devices will be used, and the methods and procedures in which the systems and devices will be used. In addition, the terms "about" and "substantially" are defined as ranges based on manufacturing variations and variations over temperature and other parameters.

Devices, systems, and methods are provided for detecting a type of accessory attached to a hair dryer, and for automatically controlling operational settings of the hair dryer based on the type of accessory detected. In general, a hair dryer is provided having an output end configured to supply air and having an attachment assembly configured to mate to one of multiple accessories. Each accessory can have an attachment assembly that is configured to interact with the attachment assembly on the hair dryer so as to enable the hair dryer to detect the type of accessory attached thereto. The hair dryer can include a controller configured to modify the operational settings based on the type of accessory detected. In an exemplary embodiment, the attachment assembly on each accessory includes features that interact with an accessory detection assembly on the hair dryer to cause the accessory detection assembly to assume a predetermined structural configuration. The predetermined structural configuration can enable the hair dryer to identify the type of accessory attached thereto. In certain exemplary embodiments, the accessory detection assembly on the hair dryer includes movable push rods that interact with an outer collar on the attachment assembly of each accessory. Each accessory can be configured to interact with the accessory to position the movable push rods in one of several unique configurations. For example, if two push rods are provided, the accessory can move both push rods, move only a first push rod, move only a second push rod, or move neither push rod, thus providing four unique structural configurations for the push rods. The push rods can be connected to switches that move between on and off positions. The type of accessory can be determined based on the position of each switch, thus enabling the operational settings for the motor and/or heater to be altered for the particular type of accessory attached to the hair dryer. Additionally, in order to enable rotation of at least some of the accessories, while still enabling the accessory to interact with the accessory detection assembly to indicate the type of accessory, the attachment assembly on the hair dryer and/or on the accessory can include features to control alignment of the accessory to at least one predetermined rotational orientation relative to the hair dryer.

FIG. 1 illustrates one exemplary embodiment of a hair dryer system 100 that includes a hair dryer 102 and one embodiment of an accessory 200 in the form of a concentrator. As shown, the hair dryer 102 generally includes an elongate housing 104 having a handle 106 extending therefrom in a generally downward direction, transverse to the housing 104. A person skilled in the art will appreciate that the hair dryer 102 can have a variety of configurations and that the features disclosed herein for detecting the type of accessory mated to the hair dryer can be used with any hair dryer known in the art.

In the illustrated embodiment, the housing 104 is in the form of a generally hollow body that is configured to contain multiple components for operation of the hair dryer, such as a motor, a heater, a processor, and a memory. The illustrated housing 104 has a circular cross-section, but other cross-sectional shapes can be utilized. In order to allow the motor and heater to supply air, the housing 104 includes an input end 104*a* and an output end 104*b* arranged on opposite ends of the housing 104. The input end 104*a* can allow for air intake into the housing 104, and the output end 104*b* can supply air after passing through the motor and/or heater. The accessory 200 can removably mate with the hair dryer 102 at the output end 104*b*, as discussed in detail below.

Since the process of hair drying can require directional control of the hair dryer, the handle 106 is included to allow for hand-held use of the hair dryer system 100. The handle 106 can extend from the housing 104 in a fixed orientation, or it can be pivotally attached to the housing 104. The handle 106 can include a power button 108, which can be configured to activate the hair dryer 102. While not shown, the handle 106 can include other control mechanisms for controlling speed and/or heat settings on the hair dryer. Additionally, a power cable 110 can extend from the handle 106 and can be electrically connected to the electrical components within the hair dryer 102, such as the motor, heater, processor, and memory.

As indicated above, various accessories can be used on a hair dryer in order to influence the output air from the hair dryer for a particular purpose. The accessory 200 shown in FIG. 1 is in the form of a concentrator that is removably mated to the output end 104*b* of the hair dryer 102 in order to concentrate the air flowing from the hair dryer 102. The illustrated accessory 200 includes a housing 202 having an air inlet 202*a* and an air outlet 202*b* arranged on opposite ends of the housing 202. Similar to the hair dryer housing 104, the accessory housing 202 is in the form of an elongate hollow body that allows air to pass there through. The air inlet 202*a* can have a shape that is complementary to the output end 104*b* of the hair dryer housing 104 in order to achieve a tight seal between the accessory 200 and the hair dryer 102 when mated. The air outlet 202*b* can have a reduced diameter, with a generally elongate ovular shape, to concentrate air. Although the accessory illustrated in FIG. 1 is a concentrator type accessory, a person skilled in the art will appreciate that various types of accessories can be removably mated to the hair dryer 102. A number of additional accessory types are described in detail below.

Figure 2A:
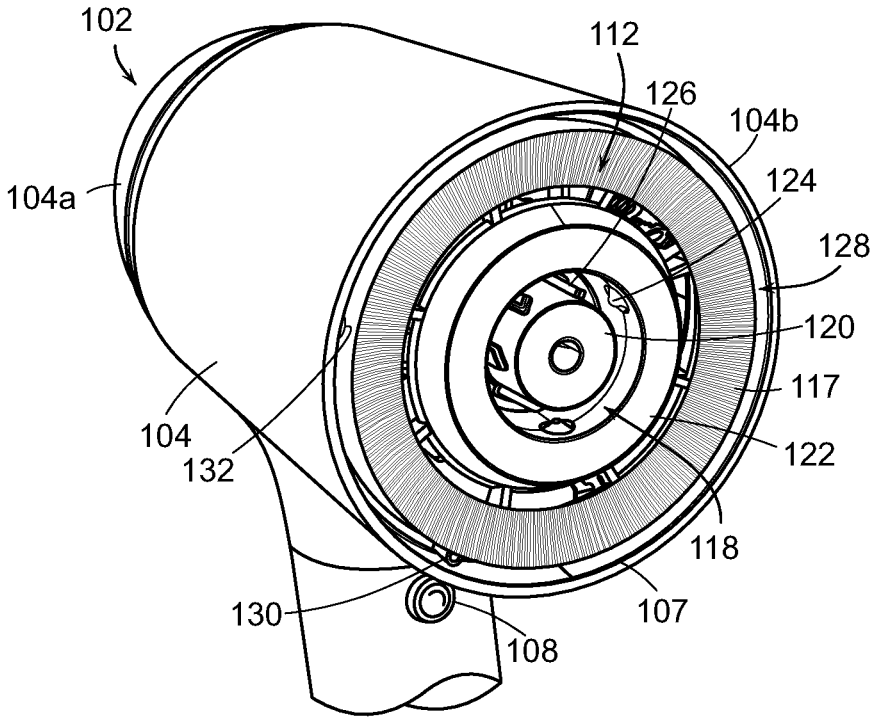
FIG. 2A is a front perspective view of the hair dryer system of FIG. 1 with the accessory removed.
Figure 2B:
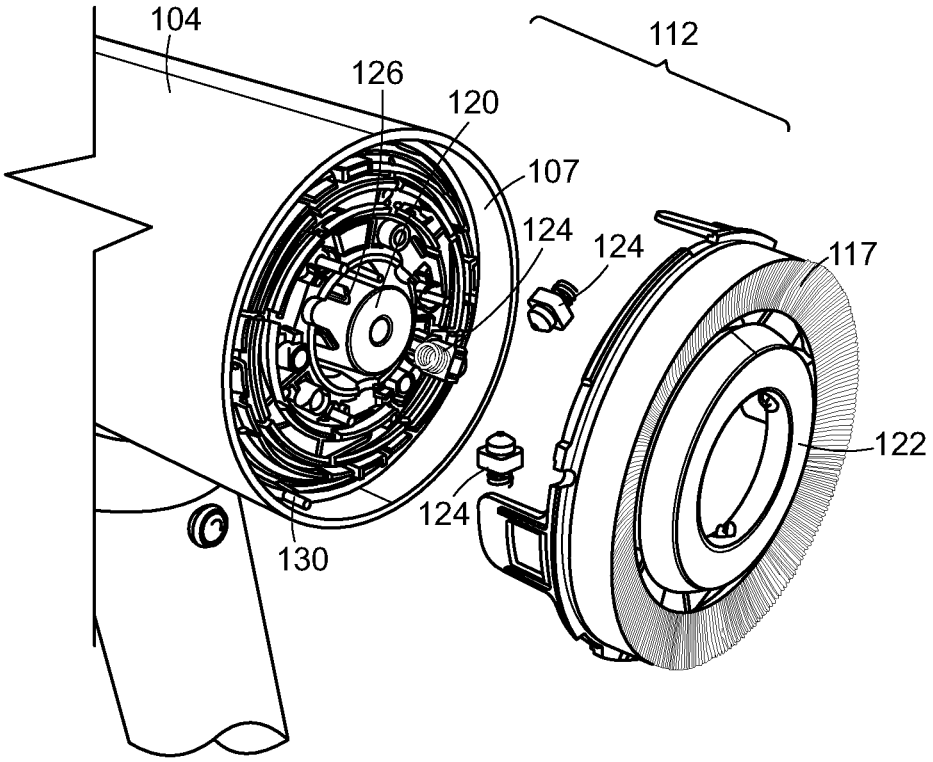
FIG. 2B is a partially exploded front perspective view of the hair dryer of FIG. 2A.
Figure 3:
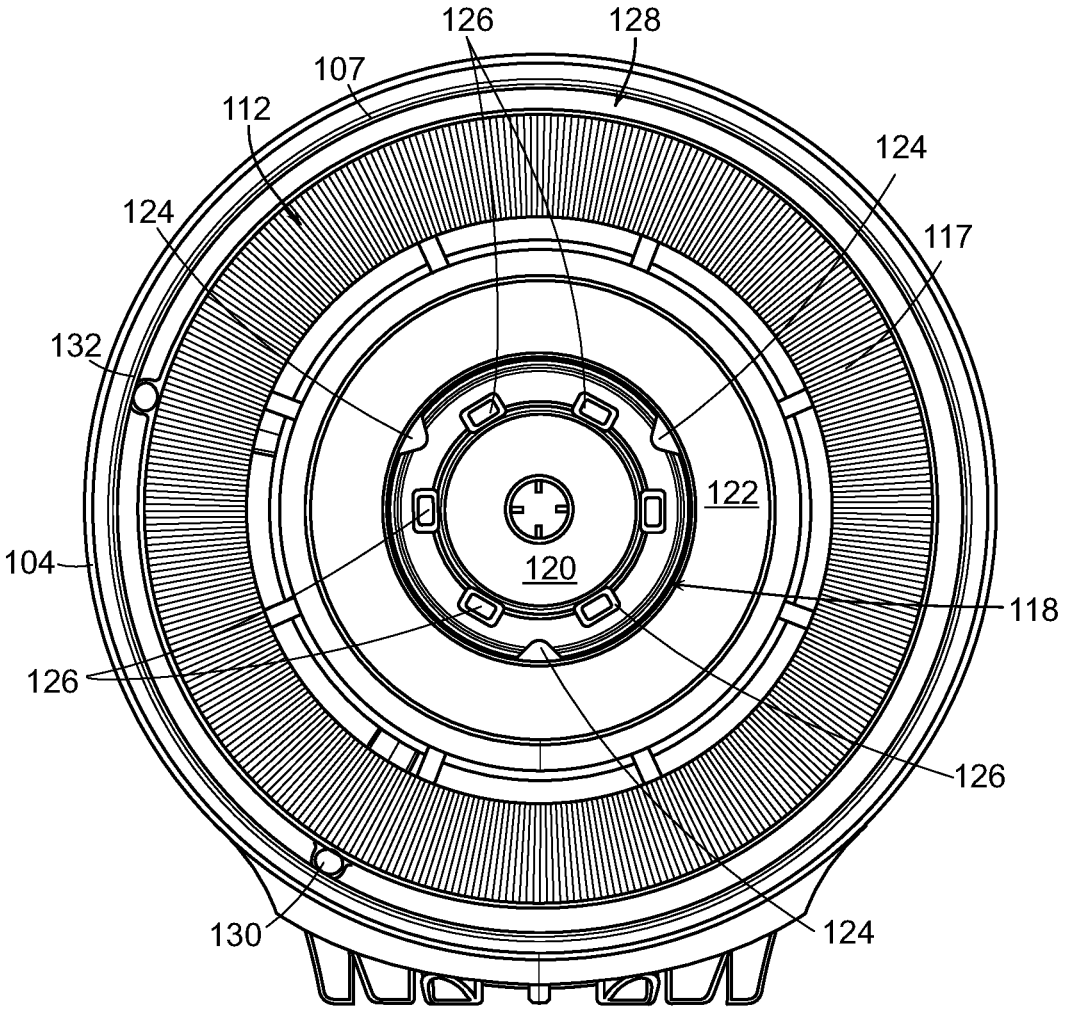
FIG. 3 is a front view of the hair dryer of FIG. 2A.

In order to removably attach an accessory to the hair dryer 102, the hair dryer 102 can include an attachment assembly 112. FIGS. 2A-3 illustrate the hair dryer 102 with the accessory 200 removed from the hair dryer 102. The illustrated attachment assembly 112 is arranged within the housing 104 at the output end 104*b*. The illustrated attachment assembly 112 generally includes a retaining mechanism for securely retaining an accessory in mating engagement with the hair dryer, an accessory detection assembly for detecting the type of accessory attached to the hair dryer, and an alignment mechanism for aligning an accessory in at least one predetermined rotational orientation relative to the hair dryer.

A variety of techniques can be used to securely retain an accessory in mating engagement with the hair dryer. In one exemplary embodiment, as shown, the retaining mechanism includes multiple biased retaining pins 124 that engage the accessory. While the retaining pins 124 can be positioned at various locations, and any numbers of retaining pins 124 can be utilized, in the illustrated embodiment the hair dryer 102 includes three retaining pins 124 located within a channel 118 formed between a center post 120 and a ring 122 positioned circumferentially around the center post 120. The retaining pins 124 are configured to removably secure an accessory to the hair dryer 102 by interacting with a retaining groove formed on an inner collar of an accessory which can extend into the channel 118, as will be discussed in detail below. In order to retain the inner collar, the retaining pins 124 can extend radially inward through apertures in the ring 122. The pins 124 can be spring-loaded such that they are biased radially inward. The springs allow the pins to move radially outward as the inner collar on an accessory is inserted into the channel 118, and allows the pins 124 to return to the radially inward position to engage the retaining groove on the inner collar. Additionally, the pins 124 can be tapered, such as being "cone-shaped," to aid in both insertion and removal of an accessory.

In addition to securing an accessory using the retaining mechanism, as indicated above the attachment assembly 112 can also include an accessory detection assembly for detecting the type of accessory attached to the hair dryer 102. While various techniques can be used to detect the type of accessory attached to the hair dryer 102, in the illustrated embodiment, the accessory detection assembly includes push rods 130, 132, which are each connected to corresponding switches within the housing 104. The push rods 130, 132 can be configured to assume a predetermined configuration in response to a type of accessory attached thereto, thereby controlling the switches to indicate the type of accessory. As shown in FIGS. 2A-7, the push rods 130, 132 are spaced apart a circumferential distance and extend axially within a channel 128 formed between a securement plate 117 and an inner surface 107 of the housing 104. Each push rod 130, 132 can be seated within a groove 131, 133 formed in an internal cover 135, and can be configured to axially slide within the groove 131, 133 between an initial extended position and a retracted position, in which the rod 130, 132 moves toward a switch to thereby move the switch between on and off positions, as discussed below. The switches can be coupled to the controller of the motor and heater such that different types of accessories can interact with the push rods 130, 132 to control the switches, thus enabling the operating parameters of the motor and heater to be controlled based on the position of the switches. As will also be described in more detail below, when an accessory is mated to the hair dryer 102, an outer collar of the accessory can extend into the channel 128. Depending on the configuration of the accessory, the accessory can remain spaced from the push rods 130, 132, can cause a particular one of the push rods to be axially displaced, or can cause both push rods 130, 132 to be axially displaced.

As indicated above, the attachment assembly can also include features to align an accessory with the hair dryer. Certain accessories may need to be rotatable with respect to the hair dryer, either 360 degrees, or between certain predetermined positions. Rotational control may be necessary based on the configuration of the accessory and/or to control alignment between an actuation mechanism on the accessory and the accessory detection assembly on the hair dryer.

In order to allow rotation of an accessory, while still enabling the accessory to interact with the push rods so as to indicate the type of accessory, an alignment mechanism can be provided for controlling a rotational orientation of the accessory relative to the accessory detection assembly. In the illustrated embodiment, the alignment mechanism is in the form of surface features formed on the center post 120. In particular, the center post 120 includes alignment tabs 126 spaced radially about on an exterior surface thereof and extending axially along the center post 120. The alignment tabs 126 can be integral with the center post 120. The alignment tabs 126 project radially outward from the center post 120 into the channel 118 and are configured to interact with complimentary surface features of an accessory's rotational alignment mechanism, such as complementary alignment tabs on an inner collar of an accessory, as described in detail below. The alignment tabs 126 can be arranged such that, when an accessory is mated to the hair dryer 102, the complimentary tabs of the inner collar are forced to slide between each of the alignment tabs 126, maintaining the accessory in a predetermination rotational orientation relative the hair dryer 102, thus ensuring that the correct push rod(s) 130, 132 of the accessory detection assembly are retracted.

As indicated above, in order to control the operating parameters of the motor and heater using the push rods 130, 132, the push rods are positioned to interact with corresponding switches 134, 136. FIGS. 4-7 illustrate the hair dryer 102 with a portion of the housing 104 removed to show the internal mechanics of the hair dryer 102, and in particular to show the push rods 130, 132 and switches 134, 136 in different structural configurations. As illustrated, each switch 134, 136 is arranged at an end of the push rod 130, 132 that is opposite to an end that interacts with the outer collar of an accessory. In some embodiments, the switches 134, 136 are light gate switches, where a light beam can be blocked by a depressed or retracted push rod, closing the circuit. Although the switches 134, 136 can be light gate switches, a person skilled in the art will appreciate that any type of switch can be used to indicate if a push rod is depressed. As described in detail below, the switches 134, 136 can either be in an on or off positon depending on the interaction between the outer collar of an accessory and the push rods 130, 132. The switches 134, 136 are communicatively coupled to a controller containing a memory for storing predetermined operational settings for the motor and heater, and a processor for executing those operational settings.

Figure 4:
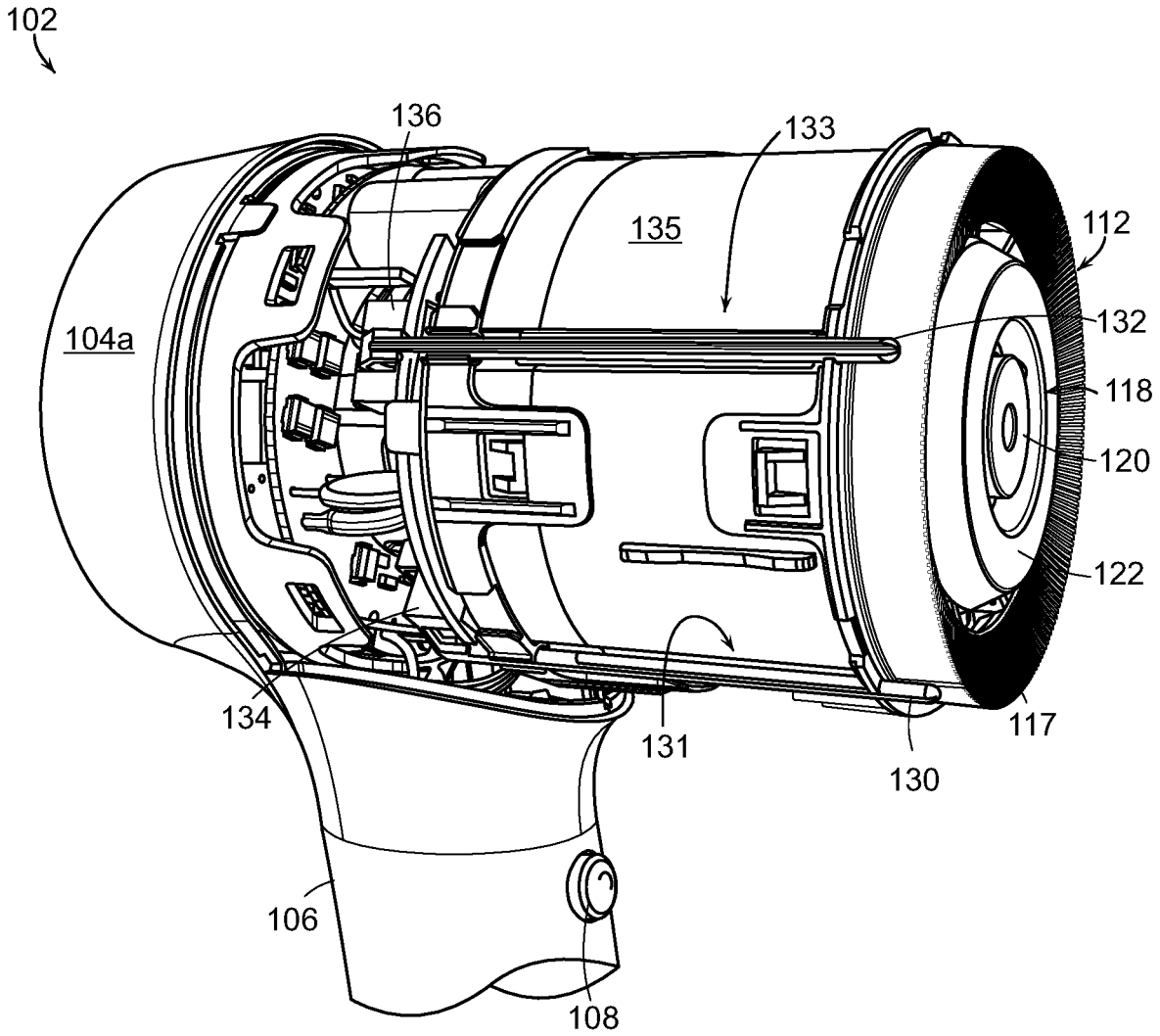
FIG. 4 is a side perspective view of the hair dryer of FIG. 2A with a portion of an outer housing removed, showing an accessory detection assembly in a first structural configuration.

As illustrated in FIG. 4, the accessory detection assembly is in a first structural configuration, with both push rods 130, 132 axially extended toward the output end 104*b*. With both push rods 130, 132 extended, both switches 134, 136 are in the same position, either on or off. For example, if a push rod is extended, then the corresponding switch would be in the off position. When both push rods 130, 132 are extended, either no accessory has been attached to the attachment assembly 112, or an accessory having an outer collar which does not contact the push rods 130, 132 is attached to the hair dryer 102. The processor can determine that neither switch is in the on position, and can then reference the stored predetermined operational setting for the motor and the heater. The processor can then execute these operational settings when the hair dryer 102 is activated by the power button 108.

Figure 5:
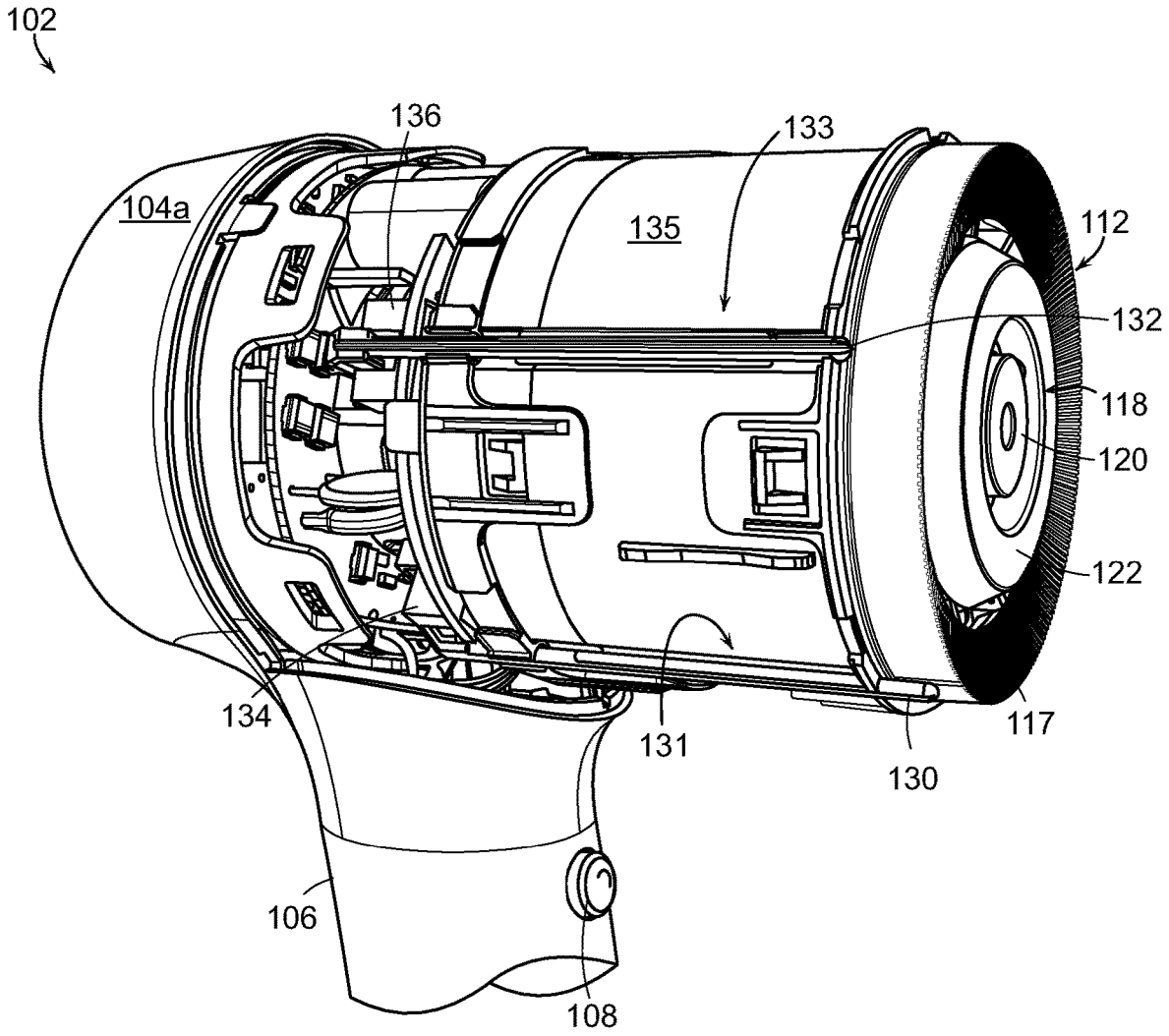
FIG. 5 is a side perspective view of the hair dryer of FIG. 4 showing the accessory detection assembly moved to a second structural configuration.

As illustrated in FIG. 5, the accessory detection assembly is in a second structural configuration, with push rod 130 axially extended and push rod 132 axially retracted. With only push rods 132 retracted, switch 134 is in the off position, while switch 136 is in the on position. When only push rod 132 is retracted, the accessory attached to the hair dryer 102 includes an outer collar which interacts with only push rod 132, and not push rod 130. The structure of the outer collar will be described in detail below, where the rotational orientation of the accessory is controlled by the interaction between the alignment tabs 126 of the alignment mechanism and the complimentary alignment tabs of on the inner collar of the accessory. The processor can determine that only switch 136 is in the on position, and can then reference the stored predetermined operational setting for the motor and the heater. The processor can then execute these operational settings when the hair dryer 102 is activated by the power button 108.

Figure 6:
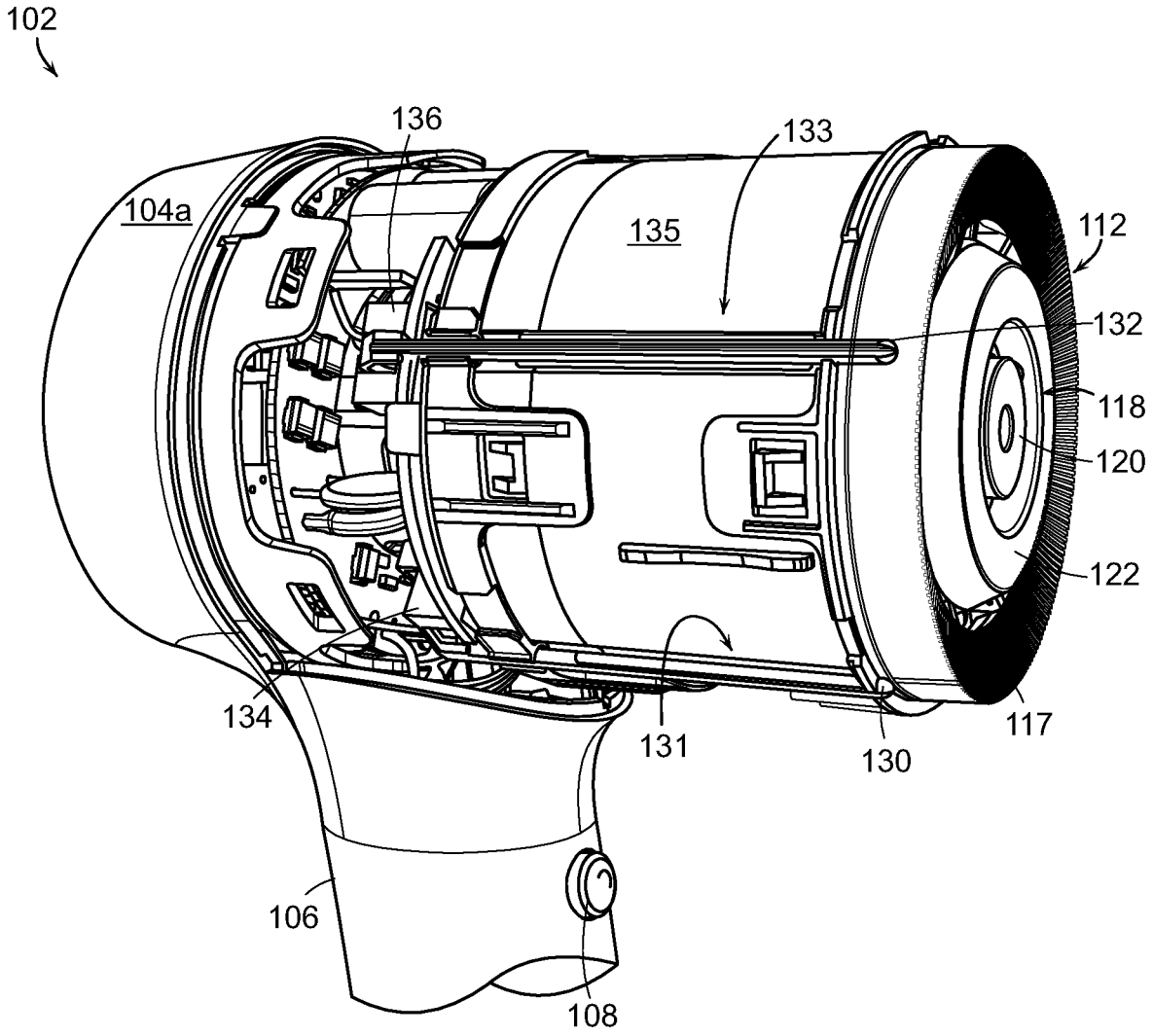
FIG. 6 is a side perspective view of the hair dryer of FIG. 4 showing the accessory detection assembly moved to a third structural configuration.

As illustrated in FIG. 6, the accessory detection assembly is in a third structural configuration, with push rod 132 axially extended and push rod 130 axially retracted. With only push rod 130 retracted, switch 136 is in the off position, while switch 134 is in the on position. When only push rod 130 retracted, the accessory attached to the hair dryer 102 includes an outer collar which can interact with only push rod 130, and not push rod 132. The structure of the outer collar will be described below in detail, where the rotational orientation of the accessory is controlled by the interaction between the alignment tabs 126 of the alignment mechanism and the complimentary alignment tabs of on the inner collar of the accessory. The processor can determine that only the switch 134 is in the on position, and can then reference the stored predetermined operational setting for the motor and the heater. The processor can then execute these operational settings when the hair dryer 102 is activated by the power button 108.

Figure 7:
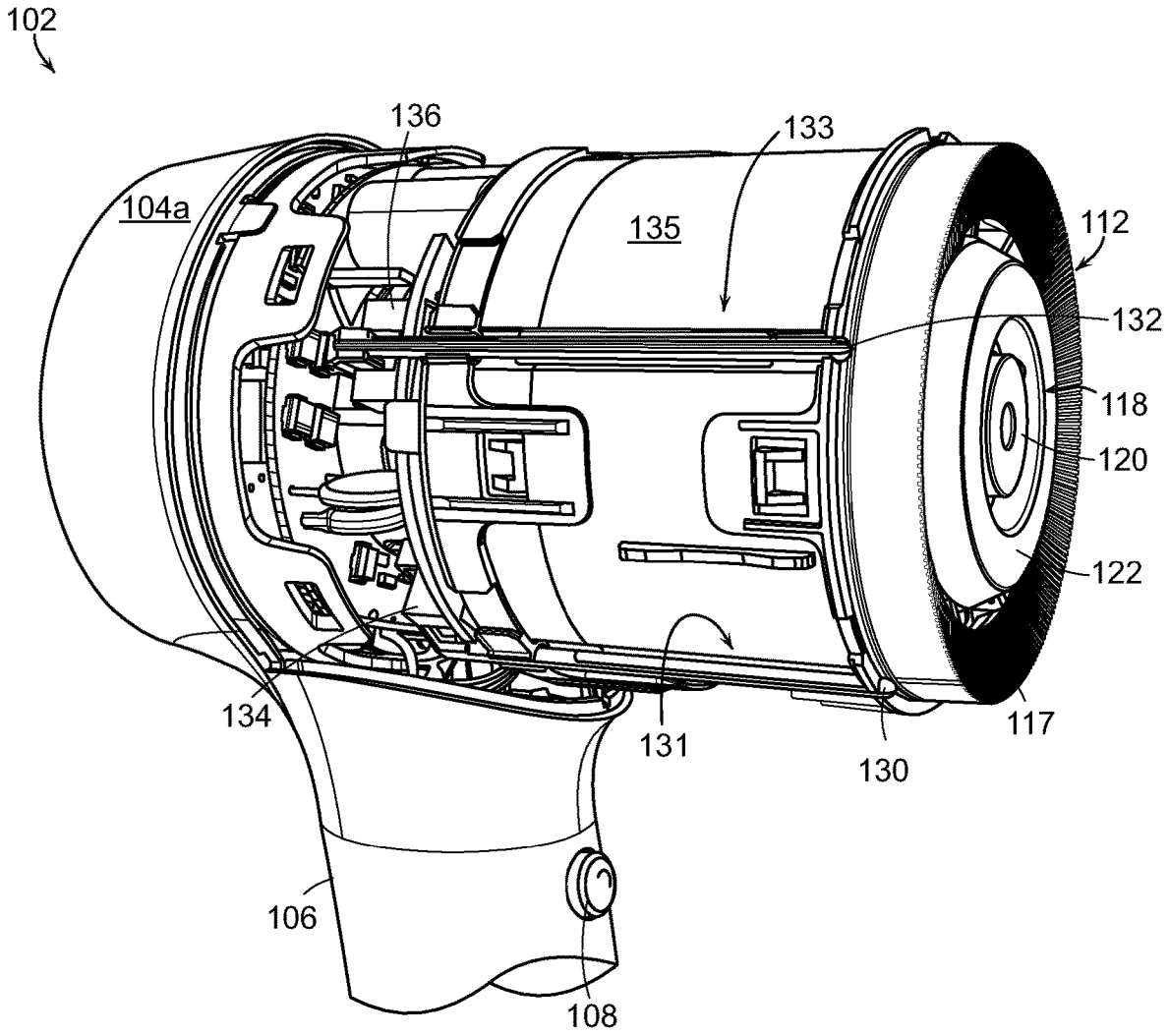
FIG. 7 is a side perspective view of the hair dryer of FIG. 4 showing the accessory detection assembly moved to a fourth structural configuration.

As illustrated in FIG. 7, the accessory detection assembly is in a fourth structural configuration, with both push rods 130, 132 axially retracted. With both push rods 130, 132 retracted, both switches 134, 136 are in the on position. When both push rods 130, 132 are retracted, the accessory attached to the hair dryer 102 contacts both the push rods 130, 132. The processor can determine that both switches are in the on position, and can then reference the stored predetermined operational setting for the motor and the heater. The processor can then execute these operational settings when the hair dryer 102 is activated by the power button 108.

Figure 8A:
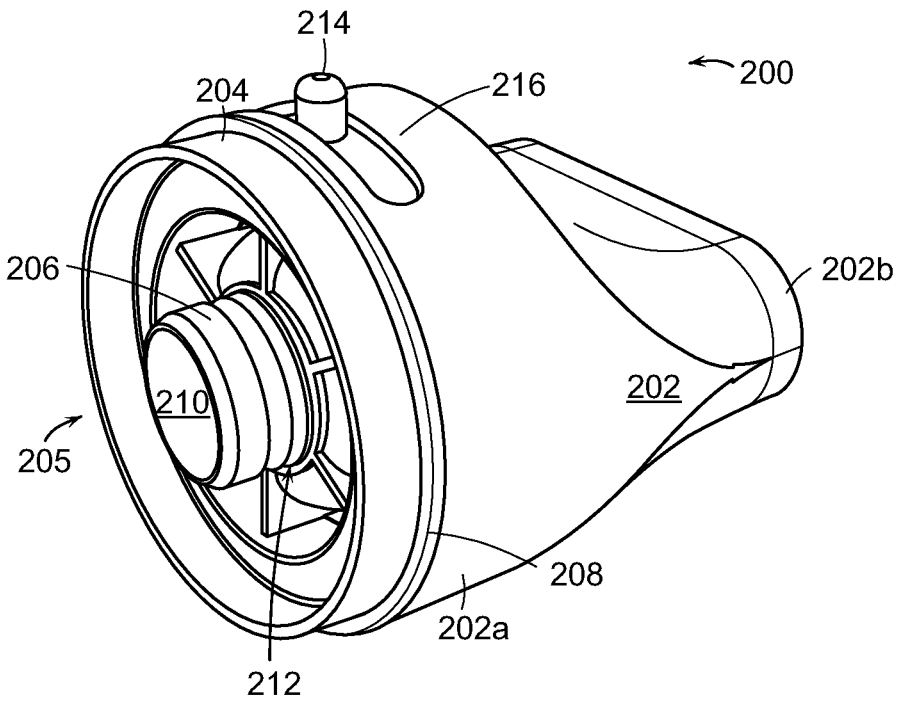
FIG. 8A is a front perspective view of the concentrator accessory of the hair dryer system of FIG. 1.
Figure 8B:
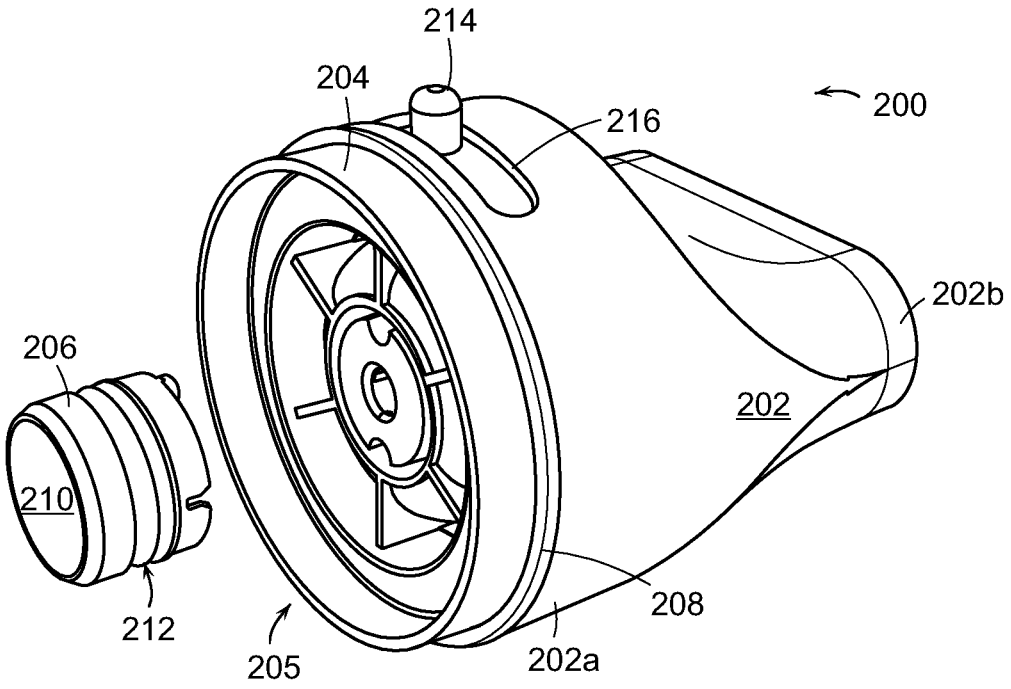
FIG. 8B is a partially exploded front perspective view of the concentrator accessory of FIG. 8A.

As stated above, various accessories can be removably attached to the hair dryer 102 in order to change the air flow from the hair dryer 102. FIGS. 8A-8B illustrate the concentrator type accessory 200 in more detail. As shown, the accessory 200 includes a housing 202 having an air inlet 202*a* and an air outlet 202*b*. Similar to the hair dryer, the air inlet 202*a* includes attachment assembly that can include a retaining mechanism to facilitate engagement with the hair dryer, an actuation mechanism to actuate the accessory detection assembly, and a rotational alignment mechanism to control the rotational orientation of the accessory relative to the hair dryer.

As shown in FIGS. 8A and 8B, the attachment assembly generally includes an outer collar 204 and an inner collar 206 for interacting with the attachment assembly on the hair dryer 102. The outer collar 204 is arranged radially outward of the inner collar 206, with both the outer collar 204 and the inner collar 206 projecting axially from the air inlet 202*a*. A shoulder 208 can be arranged on an exterior of the housing 202 at the air inlet 202*a* so that the hair dryer 102 can extend around the housing 202 and abut the shoulder 208 when the accessory 200 is attached to the hair dryer 102.

When mated to the hair dryer 102, the outer collar 204 can extend within the channel 128 formed between the housing 104 and the securement plate 117, and the inner collar 206 can extend within the channel 118 formed between the center post 120 and the ring 122. In order to facilitate secure attachment of the accessory 200 to the hair dryer 102, the inner collar 206 can include a retaining groove 212 arranged on the exterior surface thereof and extending circumferentially around the inner collar 206. As stated previously, the retaining pins 124 on the hair dryer attachment mechanism can extend into and engage the retaining groove 212 of the inner collar 206. As the inner collar 206 is inserted into the channel 118, the pins 124 are radially displaced by the inner collar 206. Once the retaining groove 212 and the pins 124 are axially aligned with the housing 104 abutting the shoulder 208, the pins 124 will extend radially into the retaining groove 212 to secure the accessory 200 to the hair dryer 102. In certain embodiments, the retaining groove 212 can be contoured in order to aid in attachment and removal of the accessory 200 from the hair dryer 102.

As previously indicated, the accessory 200 can include an actuation mechanism configured to actuate the accessory detection assembly on the hair dryer 102 to position the accessory detection assembly in one of the plurality of predetermined structural configurations, thus enabling detection of the type of accessory attached thereto. In this embodiment, the actuation mechanism is a planar surface 205 formed on the attached side of the outer collar 204, such that the collar 204 is in the form of a solid ring without additional protrusions. This configuration allows both push rods 130, 132 to remain in an initial extended position when the accessory 200 is connected to the hair dryer 102, with the outer collar 204 arranged within the channel 128 between the housing 104 and the securement plate 114. Therefore, the outer collar 204 does not interact with either of the push rods 130, 132.

Since the outer collar 204 does not interact with the push rods 130, 132, it is not necessary to rotationally align the accessory 200 with the accessory detection assembly on the hair dryer 102. Accordingly, in this embodiment, the concentrator accessory 200 is freely rotatable. The inner collar 206 can have a smooth inner surface 210. The smooth inner surface 210 does not engage with the alignment tabs 126 of the alignment mechanism, but instead rests on top of the alignment tabs 126. This arrangement of the inner collar 206 allows the accessory 200 to rotate freely relative to the hair dryer 102 when the accessory 200 is attached to the hair dryer 102.

In addition to controlling the operational settings of the motor and heater, some accessories can also include air flow controls on the accessories themselves. As shown in FIGS. 1, 8A, and 8B, the concentrator accessory 200 includes a lever 214 arranged within a slot 216 formed in the housing 202. The lever 214 can slide within the slot 216, and can be connected to an internal baffle system which can reduce the size of the air outlet 202*b*. The reduction of the size of the air outlet 202*b* can further control the speed of the air flow from the accessory 200.

Figure 9A:
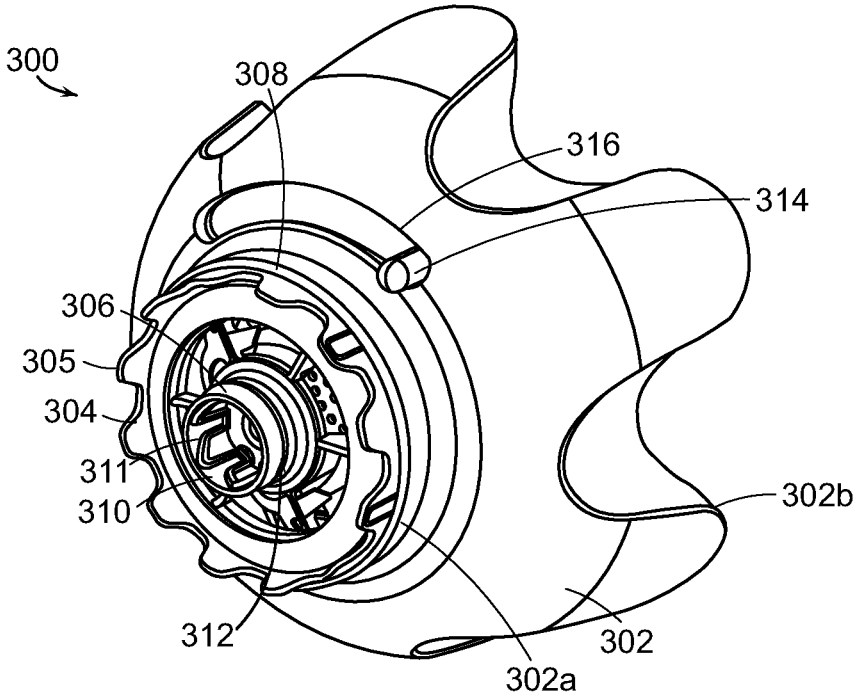
FIG. 9A is a back perspective view of one embodiment of a diffuser accessory for use with the hair dryer of FIG. 1.
Figure 9B:
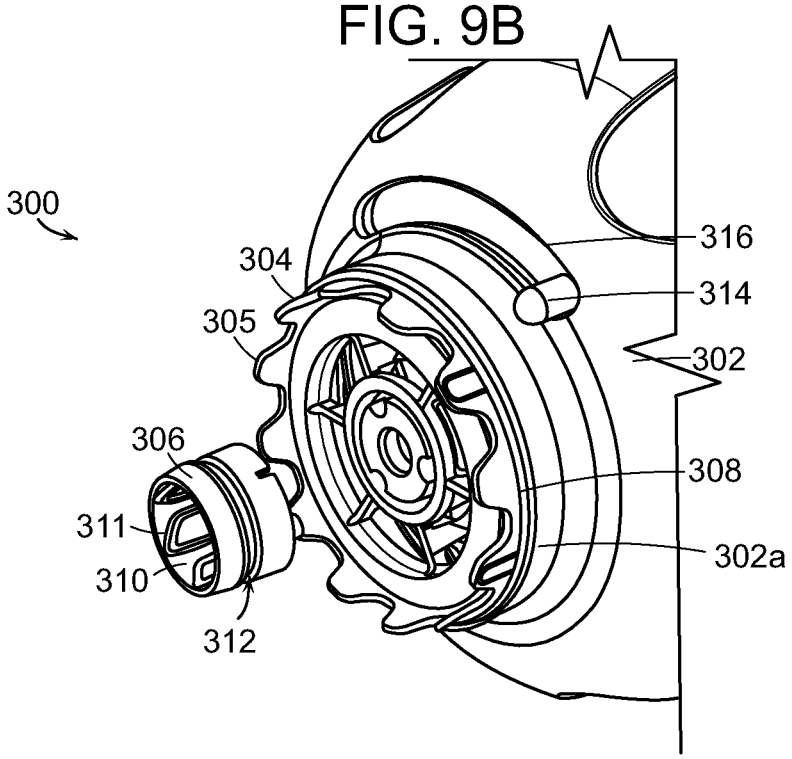
FIG. 9B is a partially exploded front perspective view of the diffuser accessory of FIG. 9A.

Another exemplary accessory is illustrated in FIGS. 9A-9B, which depict a diffuser type accessory. The accessory 300 includes a housing 302 having an air inlet 302*a* and an air outlet 302*b*. The air inlet 302*a* includes an attachment assembly for interacting with the attachment assembly on the hair dryer. Similar to the hair dryer, the attachment assembly on the accessory 300 can include a retaining mechanism to facilitate engagement with the hair dryer, an actuation mechanism to actuate the accessory detection assembly, and a rotational alignment mechanism to control the rotational orientation of the accessory relative to the hair dryer.

As shown in FIGS. 9A and 9B, the attachment assembly generally includes an outer collar 304 and an inner collar 306. The outer collar 304 is arranged radially outward of the inner collar 306, with both the outer collar 304 and the inner collar 306 projecting axially from the air inlet 302*a*. A shoulder 308 can be arranged on the housing 302 at the air inlet 302*a* so that the hair dryer 102 can abut the shoulder 308 when the accessory 300 is attached to the hair dryer 102.

As with the concentrator accessory 200, when the diffuser accessory 300 is mated to the hair dryer 102, the outer collar 304 can extend within the channel 128 formed between the housing 104 and the securement plate 117, and the inner collar 306 can extend within the channel 118 formed between the center post 120 and the ring 122. In order to facilitate secure attachment of the accessory 200 to the hair dryer 102, the inner collar 306 can include a retaining groove 312 arranged on the exterior surface of the inner collar 306, with the retaining groove 312 extending circumferentially around the inner collar 306. As stated previously, the pins 124 of the retaining mechanism can engage the retaining groove 312 of the inner collar 306, identical to how the pins 124 interact with the retaining groove 212 on the inner collar 206 of the concentrator accessory 200.

The diffuser accessory 300 can also include an actuation mechanism configured to actuate the accessory detection assembly on the hair dryer. In this embodiment, the outer collar 304 includes protrusions 305 formed on and projecting axially from an end surface of the outer collar 304. The protrusions 305 can be circumferentially arranged about the outer collar 304, and can be sized and positioned to actuate only one of the push rods 130, 132 when the accessory 300 is mated to the hair dryer 102. In this embodiment, the protrusions 305 are in the form of curved peaks with curved valleys located therebetween. The peaks and valleys are spaced such that one protrusion aligns with one of the push rods while a valley aligns with the other push rod. As a result, the one push rod aligned with a protrusion will be moved to the retracted position, thereby causing the corresponding switch to switch from off to on. The other push rod will remain in the extended position, with the corresponding switch remaining off.

In order to properly align the actuation mechanism on the accessory 300 with the hair dryer so as to actuate a predetermine one of the push rods 130, 132, the inner collar 306 can include alignment tabs 311 arranged on the inner surface 310 thereof. The alignment tabs 311 can be in the form of protruding surface features having a shape that is complimentary to the shape of alignment tabs 126 on the hair dryer 102. This arrangement of the inner collar 306 controls the rotational orientation of the accessory 300 relative to the hair dryer 102 when the accessory 300 is attached to the hair dryer 102. As the inner collar 306 is inserted into the channel 118 on the hair dryer 102, the alignment tabs 126 and 311 mesh, causing the protrusions 305 to align with a predetermined one of the push rods 130, 132. The accessory 300 is prevented from rotating on the hair dryer 102. However, the rotational alignment mechanism allows the accessory 300 to be attached to the hair dryer 102 at various rotational positions, rather than requiring a user to align the accessory 300 in one specific orientation relative to the hair dryer. In other words, the accessory 300 can be attached to the hair dryer in any rotational orientation, and the tabs 126, 311 will interact to properly align the protrusions 305 with the rods 130, 132 of the accessory detection member. In order to ensure that the protrusions 305 of the outer collar only contact the correct push rod 130, 132 when attaching the accessory 300 at any of the various available rotational positions, the rotational position of both the outer collar 304 and the inner collar 306 can be fixed with respect to one another.

In addition to controlling the operational settings of the motor and heater, the accessory 300 can also include an air flow control, similar to the accessory 200. The accessory 300 can include a lever 314 arranged within a slot 316 formed in the housing 302. The lever 314 can slide within the slot 316, and is connected to the prongs on the end of the diffuser, which allow the prongs to be retracted into the diffuser.

Figure 10A:
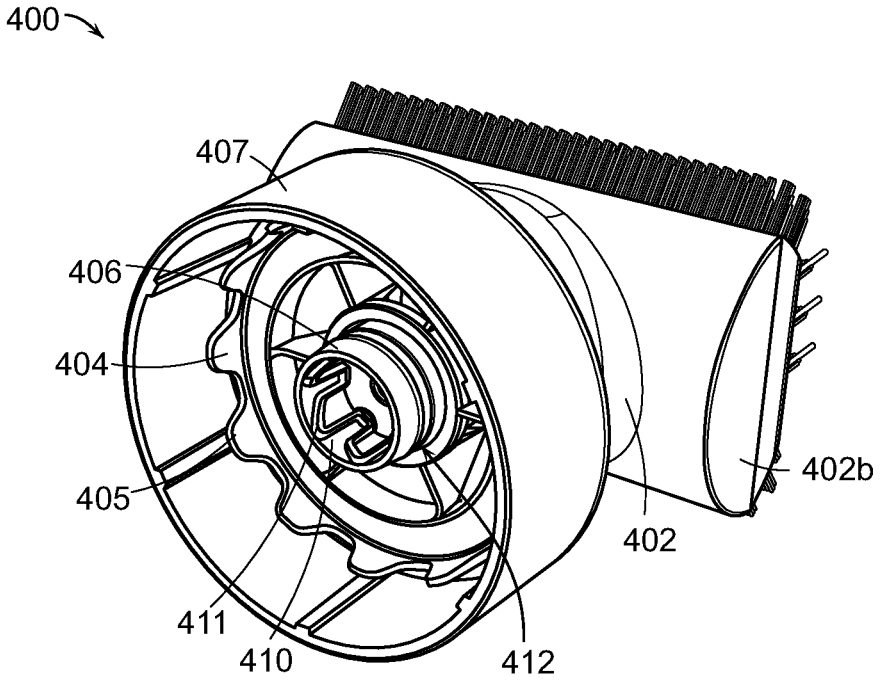
FIG. 10A is a back perspective view of one embodiment of a brush accessory for use with the hair dryer of FIG. 1.
Figure 10B:
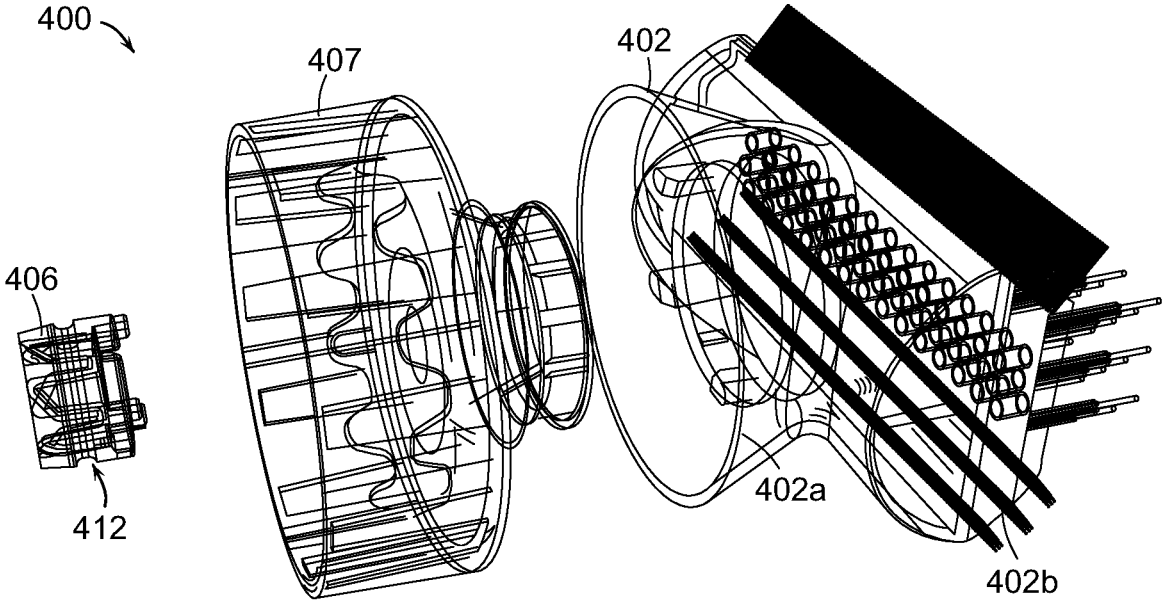
FIG. 10B is a partially exploded front perspective view of the brush accessory of FIG. 10A.

FIGS. 10A-10B illustrate another embodiment of an accessory in the form of a brush type accessory 400. The accessory 400 is substantially similar to accessory 300, and includes a housing 402 having an air inlet 402*a* and an air outlet 402*b*. The air outlet 402*b* includes an attachment assembly for interacting with the attachment assembly on the hair dryer. Similar to the hair dryer, the attachment assembly on the brush accessory 400 can include a retaining mechanism to facilitate engagement with the hair dryer, an actuation mechanism to actuate the accessory detection assembly, and a rotational alignment mechanism to control the rotational orientation of the accessory relative to the hair dryer.

As shown in FIGS. 10A-10B, the attachment assembly generally includes an outer collar 404 arranged radially outward of an inner collar 406, with both the outer collar 404 and the inner collar 406 projecting axially from the air inlet 402*a*. The illustrated accessory 400 further includes a support collar 407 positioned radially outward of and around the outer collar 404. The support collar 407 is configured to extend around the housing 104 of the hair dryer to provide further support. Such a collar can be utilized with heavier accessories or with accessories that receive a significant force during use.

Similar to the diffuser accessory 300, the inner collar 406 of the brush accessory 400 can include a retaining groove 412 arranged on the exterior surface of the inner collar 406. As previously stated, the pins 124 of the attachment assembly 112 can be configured to extend into and engage the retaining groove 412 of the inner collar 406, identical to how pins 124 interact with retaining groove 212 of inner collar 206.

Furthermore, similar to accessory 300, the outer collar 404 can include protrusions 405 formed on an end surface thereof and extending axially from the outer collar 404. The illustrated protrusions 405 have a configuration similar to protrusions 305 and are configured to contact only one of the push rods 130, 132 when the accessory 400 is attached to the hair dryer 102. Thus, when the accessory 400 is attached to the hair dryer 102, the outer collar 4304 will extend into the channel 128 between the housing 104 and the securement plate 114 and one of the protrusions 405 will contact and move one of the push rods to the extended position, while the other protrusion extends into a valley between adjacent protrusions 405.

Similar to the diffuser accessory 300, the brush accessory 400 can also include alignment tabs 411 arranged on the inner surface 410 of the inner collar 406. The alignment tabs 411 are complimentary to and engage with the alignment tabs 126 of the alignment mechanism when the inner collar 406 is inserted into the channel 118. This arrangement of the inner collar 406 controls the rotational orientation of the accessory 400 relative to the hair dryer 102 when the accessory 400 is attached to the hair dryer 102.

In order to enable the hair dryer 102 to distinguish between the diffuser accessory 300 and the brush accessory 400, the alignment tabs 411 on the brush accessory 400 can be configured to align the protrusions 405 to cause a different one of the push rods 130, 132 to move to the retracted position as compared to the brush accessory 400. This can be achieved by forming the alignment tabs 411 and the protrusions 405 at a position relative to one another that results in the desired alignment. Since the inner collar 406 and outer collar 404 are non-rotatably connected to the housing 402, the rotational position of both the inner collar 406 and the outer collar 404 are fixed with respect to one another, thus ensuring that the protrusions 405 of the outer collar 404 only contact the correct push rod 130, 132 when attaching the accessory 400 at any of the various available rotational positions. For example, when the diffuser accessory 300 is attached to the hair dryer 102, the protrusions 305 can only contact push rod 130. In comparison, when the brush accessory 400 is attached to the hair dryer 102, the protrusions 405 can only contact push rod 132. Because of this arrangement, the hair dryer system 100 can detect and utilize different operating parameters for the diffuser accessory 300 and the brush accessory 400 without requiring user input.

Figure 11A:
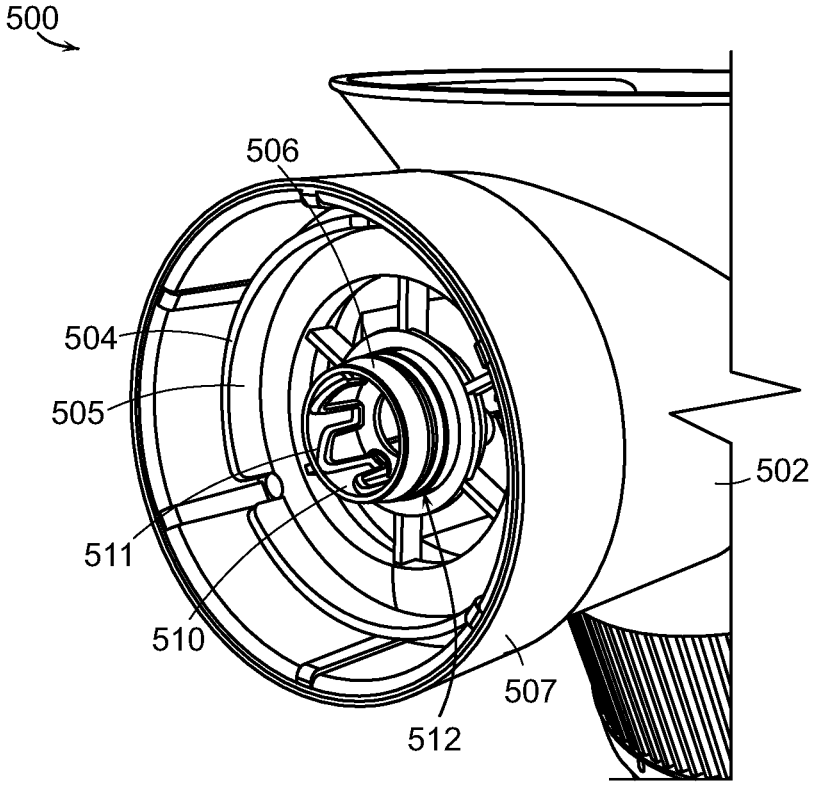
FIG. 11A is a back perspective view of a portion of one embodiment of an air curler accessory for use with the hair dryer of FIG. 1.
Figure 11B:
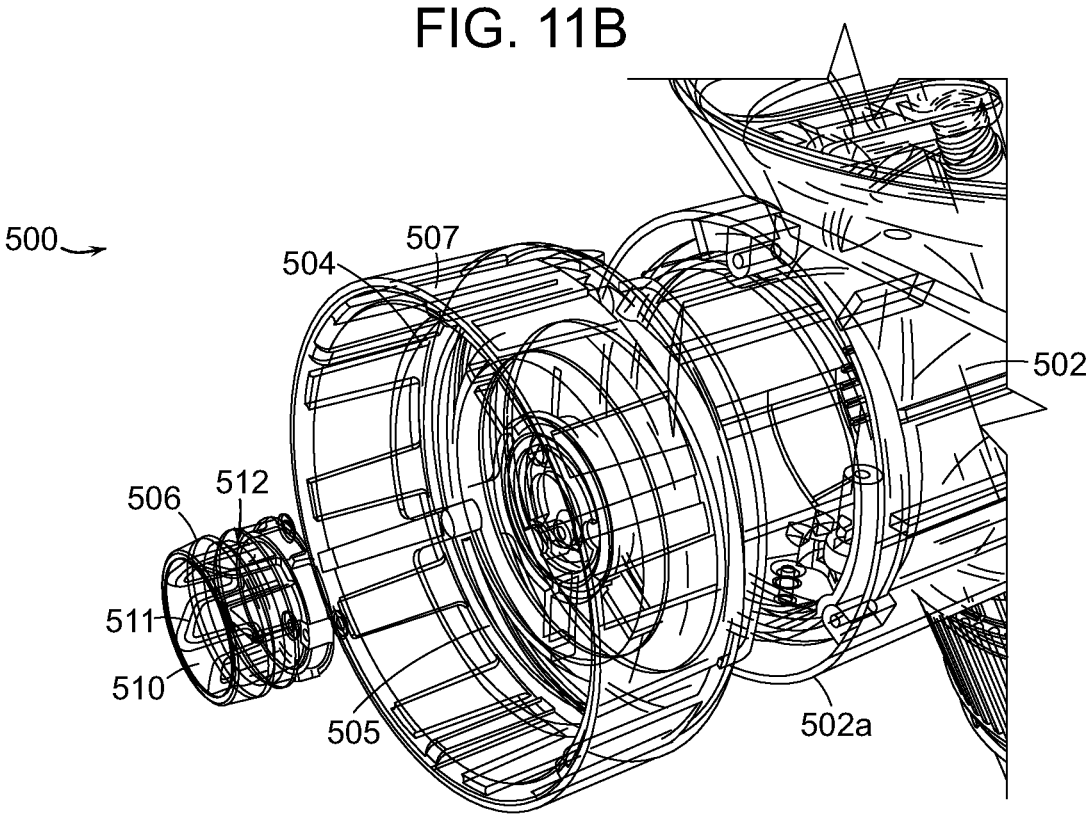
FIG. 11B is a partially exploded front perspective view of the air curler accessory of FIG. 11A.

Another exemplary accessory is illustrated in FIGS. 11A-11B, which depict a curler type accessory. The accessory 500 includes a housing 502 having an air inlet 502*a* and an air outlet 502*b*. The air outlet 502*b* includes an attachment assembly for interacting with the attachment assembly on the hair dryer. Similar to the hair dryer, the attachment assembly on the curler accessory 500 can include a retaining mechanism to facilitate engagement with the hair dryer, an actuation mechanism to actuate the accessory detection assembly, and a rotational alignment mechanism to control the rotational orientation of the accessory relative to the hair dryer.

As shown in FIGS. 11A-11B, the attachment assembly generally includes an outer collar 504 arranged radially outward of an inner collar 506. The illustrated accessory 500 further includes a support collar 507 positioned radially outward of and around the outer collar 504. The support collar 507 is configured to extend around the housing 104 of the hair dryer to provide further support. Such a collar can be utilized with heavier accessories or with accessories that receive a significant force during use.

Similar to the other accessories, the inner collar 506 of the curler accessory 500 can include a retaining groove 512 arranged on the exterior surface of the inner collar 506. As stated previously, the pins 124 of the retaining mechanism can be configured to extend into and engage the retaining groove 512 of the inner collar 506, identical to how the pins 124 interact with the retaining groove 212 of the inner collar 206.

As with the other accessories, the attachment assembly on the curler accessory 500 can also include an actuation mechanism for actuating the accessory detection assembly on the hair dryer to enable the hair dryer to detect the type of accessory attached thereto. In this embodiment, similar to the accessory 200, the outer collar 504 is a solid ring without additional protrusions. However, the outer collar 504 can be configured to interact with both push rods 130. In particular, when the accessory 500 is attached to the hair dryer 102, the outer collar 504 can extend into the channel 128 between the housing 104 and the securement plate 114 by a distance that causes the push rods 130, 132 to move from the extended position to the retracted position.

While the outer collar 504 has a planar configuration and can be mated in any rotational orientation relative to the hair dryer 102, the inner collar 506 can still include alignment features so as to align the accessory relative to the hair dryer. The design of the accessory 500 could cause a lever moment due to the design and weight of the accessory 500. The alignment tabs 511 can thus prevent unintentional rotation of the accessory 500 while in use. Accordingly, the inner collar 506 can include a rotational alignment mechanism, such as alignment tabs 511 arranged on the inner surface 510 thereof. The alignment tabs 511, similar to the alignment tabs 311 on the inner collar 306 of the diffuser accessory 300, are complimentary to and engage with the alignment tabs 126 of the alignment mechanism when the inner collar 506 is inserted into the channel 118 on the hair dryer 102. This arrangement of the inner collar 506 controls the rotational orientation of the accessory 500 relative to the hair dryer 102 when the accessory 500 is attached to the hair dryer 102.

In certain embodiments, the alignment tabs on any of the accessories disclosed herein can be configured to position the accessory in a predetermined number of fixed rotational orientations relative to the hair dryer. By way of example, a first accessory, such as the curler accessory 500, can include a single alignment tab that only allows the accessory to attach with the hair dryer 102 in a single orientation, whereas a second accessory, such as the brush accessory 400, can include two alignment tabs which allow the accessory 500 to attach to the hair dryer 102 in two separate orientations. Other accessories can include three alignment tabs which would allow the accessory to attach to the hair dryer 102 in three separate orientations, four alignment tabs which would allow the accessory to attach to the hair dryer in four separate orientations, etc. The particular number of alignments tabs can vary depending on the particular type of accessory and the desired rotational orientation thereof. Moreover, as previously indicated with respect to the diffuser accessory 200, the accessory can lack alignment tabs altogether to enable the accessory to rotate freely relative to the hair dryer.

While the rotational alignment mechanism on each accessory can vary as desired depending on the type of accessory, the actuation mechanism on each accessory and its interaction with the accessory detection assembly on the hair dryer can likewise vary. However, the rotational alignment mechanism may be limited by the actuation mechanism. For example, a rotational alignment mechanism that allows for free rotation of the accessory can be utilized in combination with an actuation mechanism that either allows the push rods 130, 132 to remain in the extended position or that causes both push rods 130, 132 to move to the retracted position. On the contrary, where a particular one of the push rods 130, 132 is moved to the retracted position, the rotational alignment mechanism may need to have a configuration that aligns the actuation mechanism with the push rods 130, 132 so as to effect actuation of the particular one of the push rods 130, 132. Accordingly, a person skilled in the art will appreciate that each accessory can have an actuation mechanism and a rotational alignment mechanism that work in coordination to provide the desired rotation, while still allowing the hair dryer to detect the type of accessory.

As previously discussed, when any one of the accessories 200, 300, 400, 500 is attached to the hair dryer, the resulting structural configuration of the accessory detection mechanism will enable the hair dryer 102 to detect the type of accessory attached thereto. The hair dryer can 102 thus automatically control the operational settings based on the type of accessory detected. In general, operational settings for the motor and heater can have multiple levels, such as low, medium, and high. For example, a low speed setting for the motor can be in the range of 20-25 cubic feet per minute (CFM). A medium speed setting for the motor can be in the range of 25-30 CFM. A high speed setting for the motor can be in the range of 30-35 CFM. Additionally, a low heat setting for the heater can be in the range of 55-70° C. A medium heat setting for the heater can be in the range of 70-85° C. A high heat setting for the heater can be in the range of 85-100° C.

Each of the accessories can have different operational settings. For example, the operational settings for a concentrator type accessory 200 can be a high motor speed setting and a high heat setting. The operational settings for a diffuser type accessory 300 can be a medium motor speed setting and a low heat setting. The operational settings for a brush type accessory 400 can be a low motor speed setting and a medium heat setting. However, a person skilled in the art will understand that the listed operational settings for each type of accessory can be altered depending on the operating requirements of the hair dryer.

Figure 12:
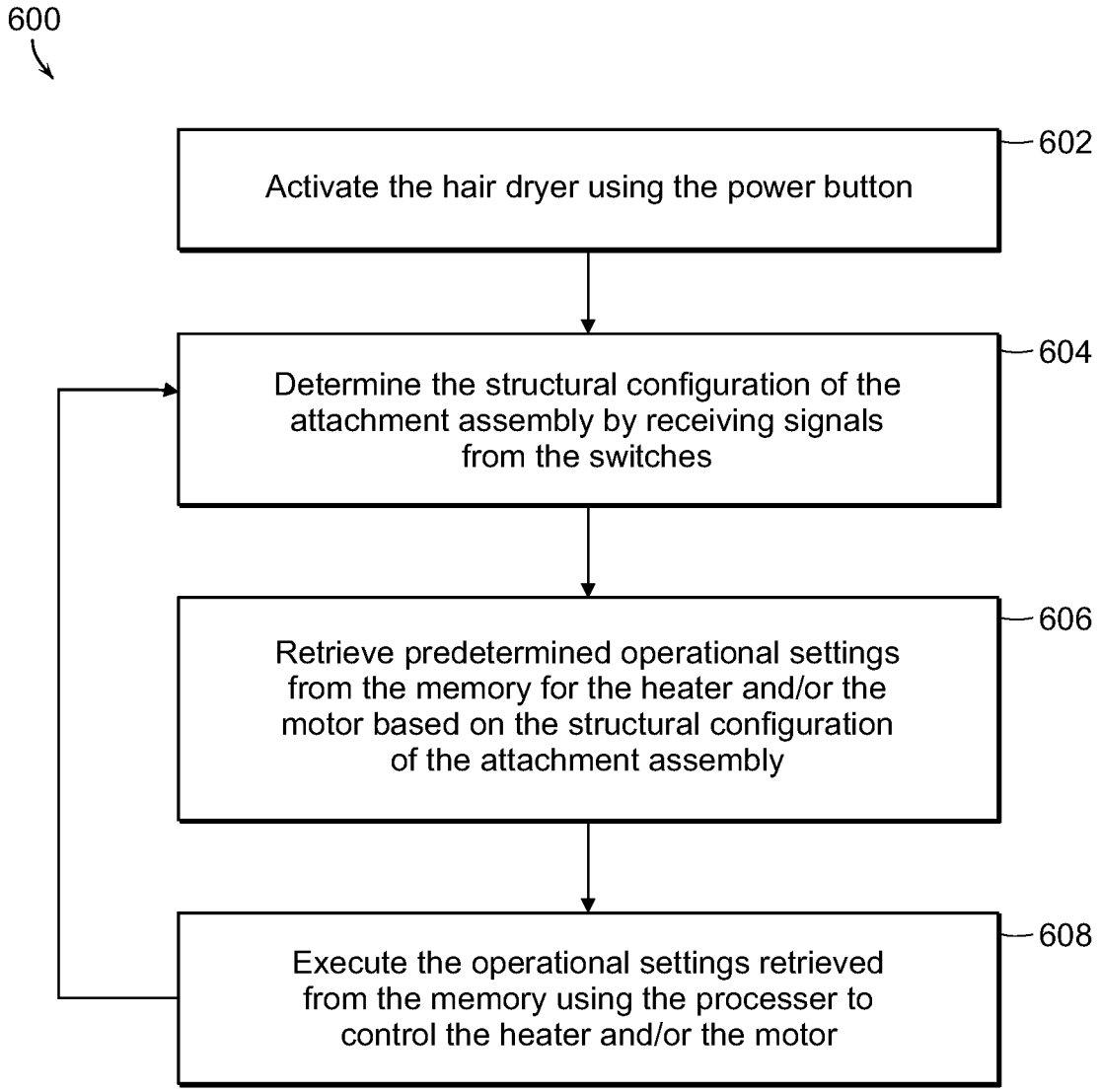
FIG. 12 depicts a method of operation of the hair dryer system of FIG. 1.

As discussed previously, the hair dryer 102 includes a controller having a processor and a memory storing predetermined operational settings. A method 600 by which the controller operates the hair dryer 102 is depicted in FIG. 12. The switches 134, 136 are connected to the controller in order to send an electrical signal from the switch to the controller. At step 602, the hair dryer 102 is activated by a user pressing the power button 108 on the hair dryer 102. Once activated, the controller needs to determine which structural configuration the attachment assembly 112 is in by determining position of the switches 134, 136. At step 604, a signal is sent from the switches 134, 136 when the hair dryer 102 is in operation in order for the hair dryer 102 to determine which operational settings to execute from the memory. As the switches 134, 136 are actuated by the pushrods 130, 132 during attachment and removal of the various accessories, the signals being sent to the controller will alternate and correspond with the new position of the switches 134, 136. In the illustrated embodiment, since there are two switches, there can be four predetermined operational settings, namely both switches off, both switch on, a first switch on and a second switch off, and a first switch off and a second switch on. At step 606, each operational setting can have unique motor and/or heat settings stored in the memory and can be retrieved from the memory based on the signals from the switches 134, 136. At step 608, once the corresponding operational settings are retrieved from the memory, the processor can execute the operational settings for the heater and/or motor. For example, with just switch 134 actuated, a predetermined operational setting for the heater and motor is executed by the processor from the memory which corresponds to having only the switch 134 actuated. When switch 134 is no longer actuated, the processor can use the stored operational settings to change the operating settings for the motor and heater which correspond to the new structural configuration of the switches 134, 136 by repeating steps 604-608.

In the illustrated embodiment, there are four accessories 200, 300, 400, 500 described, with each accessory having its own unique operational settings for the motor and heater. However, while four accessories are described, any number of accessories can be provided and used with the hair dryer 102. Multiple accessories can be provided which can operate at the same operational settings as one of the accessories 200, 300, 400, 500, causing the accessory detection assembly to move to the same structural configuration to operate at the same operational settings. Additionally, while only two push rods and switches are disclosed in the illustrated embodiment, the hair dryer can include any number of push rods and switches to allow for more than four combinations, and thus more than four predetermined stored operational settings.

Certain exemplary implementations have been described to provide an overall understanding of the principles of the structure, function, manufacture, and use of the systems, devices, and methods disclosed herein. One or more examples of these implementations have been illustrated in the accompanying drawings. Those skilled in the art will understand that the systems, devices, and methods specifically described herein and illustrated in the accompanying drawings are non-limiting exemplary implementations and that the scope of the present invention is defined solely by the claims. The features illustrated or described in connection with one exemplary implementation may be combined with the features of other implementations. Such modifications and variations are intended to be included within the scope of the present invention. Further, in the present disclosure, like-named components of the implementations generally have similar features, and thus within a particular implementation each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described implementations. Accordingly, the present application is not to be limited by what has been particularly shown and described, except as indicated by the appended claims. All publications and references cited herein are expressly incorporated by reference in their entirety.

The invention claimed is:

1. A hair drying system, comprising:

a plurality of different types of accessories; and a hair dryer having an output end configured to supply air, the output end including an attachment assembly having a retaining mechanism configured to selectively engage each of the plurality of different types of accessories to retain a selected one of the plurality of different types of accessories on the hair dryer, an alignment mechanism configured to align at least one of the plurality of different types of accessories in a single predetermined rotational orientation relative to the output end, and an accessory detection assembly having at least a portion configured to translate axially relative to a direction of the air supplied at the output end and to move to one of a plurality of predetermined structural configurations based on the type of accessory attached to the hair dryer, the hair dryer further including a controller configured to control the supply of air through the output end in dependence on the predetermined structural configuration of the accessory detection assembly.

2. The system of claim 1, wherein at least one of the plurality of different types of accessories includes an alignment mechanism configured to interact with the alignment mechanism on the hair dryer to align the at least one accessory in the single predetermined rotational orientation relative to the output end.

3. The system of claim 2, wherein the hair dryer alignment mechanism comprises at least one surface feature formed on a central hub of the hair dryer attachment assembly, and wherein the accessory alignment mechanism comprises at least one complementary surface feature formed on an inner collar of the at least one of the plurality of different types of accessories.

4. The system of claim 1, wherein each of the plurality of different types of accessories includes an actuation mechanism configured to actuate the accessory detection assembly to position the accessory detection assembly in one of the plurality of predetermined structural configurations.

5. The system of claim 4, wherein the accessory detection assembly includes first and second push rods each having a predefined position for each of the predetermined structural configurations of the hair dryer attachment assembly.

6. The system of claim 5, wherein each of the plurality of different types of accessories includes an actuation mechanism selected from the group consisting of: a planar outer collar that allows the first and second push rods to remain in an initial position, a collar having protrusions configured to actuate only the first push rod, a collar having protrusions configured to actuate only the second push rod, and a collar having protrusions configured to actuate each of the first and second push rods.

7. The system of claim 1, wherein each of the plurality of different types of accessories includes an attachment assembly having a retaining groove configured for mating engagement with the retaining mechanism on the hair dryer.

8. The system of claim 7, wherein the retaining mechanism on the attachment assembly of the hair dryer comprises at least one biased pin configured to engage the retaining groove.

9. The system of claim 1, wherein movement of the attachment assembly between the plurality of predetermined structural configurations is configured to control an on/off position a plurality of switches, the plurality of switches having a unique combination of on/off positions that correspond to the type of accessory attached to the attachment assembly.

10. The system of claim 1, further comprising a memory in the housing storing a plurality of predetermined stored settings that each correspond to one of the plurality of different types of accessories, each setting including a first operating parameter for a motor of the hair dryer and a second operating parameter of a heater of the hair dryer.

11. The system of claim 10, further comprising a processor in the housing communicatively coupled to the attachment assembly and the memory such that the processor is configured to determine the type of accessory based on the structural configuration of the hair dryer attachment assembly, and is configured to control a speed of the motor based on the first operating parameter for the determined type of accessory and to control a heat of the heater based on the second operating parameter for the determined type of accessory.

12. The system of claim 3, wherein:

the at least one of the plurality of different types of accessories also includes an outer collar configured to cause the hair dryer attachment assembly to move to the one of the plurality of predetermined structural configurations; and the one of the plurality of predetermined structural configurations corresponds to a first operational setting of the hair dryer when the at least one of the plurality of different types of accessories is attached to the hair dryer.

13. The system of claim 12, wherein the outer collar includes a first plurality of extrusions configured to interact with a plurality of switches in the hair dryer.

14. The system of claim 12, wherein the at least one complementary surface feature formed on the inner collar includes a plurality of tabs.

15. The system of claim 1, wherein the plurality of different types of accessories comprises:

a first accessory having a first end with an air inlet and a second end with an air outlet, the first end including a first attachment assembly having:

a first retaining groove configured to mate with the retaining mechanism, a first outer collar having a plurality of first protrusions formed thereon and configured to actuate the accessory detection assembly, and a first inner collar having a first alignment mechanism configured to align the first accessory in the single predetermined rotational orientation relative to the hair dryer; and a second accessory having a first end with an air inlet and a second end with an air outlet, the first end including a second attachment assembly having:

a second retaining groove configured to mate with the retaining mechanism, a second outer collar having a planar surface configured such that the second outer collar enables the accessory detection assembly to remain in an initial position, and a second inner collar configured to mate with the hair dryer such that the second accessory is freely rotatable relative to the hair dryer.

16. The system kit of claim 15, wherein the plurality of different types of accessories comprise:

a third accessory having a first end with an air inlet and a second end with an air outlet, the first end including a third attachment assembly having:

a third retaining groove configured to mate with the retaining mechanism, a third outer collar having a plurality of third protrusions formed thereon and configured to actuate the accessory detection assembly, the plurality of third protrusions differing from the plurality of first protrusions, and a third inner collar having a third alignment mechanism configured to align the third accessory in the single predetermined rotational orientation relative to the hair dryer.

17. The system of claim 1, wherein the hair dryer includes:

a hand-held housing, and a motor arranged within the hand-held housing and configured to supply air through the output end; and wherein the controller is configured to control the supply of air by controlling the motor based on a plurality of predetermined stored settings corresponding to the type of accessory attached to the hair dryer.

18. The system of claim 17, wherein each of the plurality of different types of accessories includes an attachment assembly including an inner collar having at least one surface feature configured to interact with a corresponding surface feature on an accessory to align the accessory in the single predetermined rotational orientation relative to the output end.

19. The system of claim 18, further comprising:

a memory in the hand-held housing storing the plurality of predetermined stored settings.

20. The system of claim 1, wherein at least one of the plurality of different types of accessories includes an alignment mechanism configured to interact with the alignment mechanism on the hair dryer to align the at least one accessory in the single predetermined rotational orientation relative to the output end;

movement of the attachment assembly between the plurality of predetermined structural configurations is configured to control an on/off position a plurality of switches, the plurality of switches having a unique combination of on/off positions that correspond to the type of accessory attached to the attachment assembly;

the system further comprises a memory in the housing storing a plurality of predetermined stored settings that each correspond to one of the plurality of different types of accessories, each setting including an operating parameter for an air supply of the hair dryer; and the system further comprises a processor in the housing communicatively coupled to the attachment assembly and the memory and configured to cause the air supply to operate based on the predetermined stored setting for the determined type of accessory.

21. A hair dryer system, comprising:

a plurality of different types of accessories; and a hair dryer configured to removably mate with a selected one of the plurality of different types of accessories, the hair dryer comprising:

a motor, a heater, an air inlet, an air outlet configured to supply heated air, a memory configured to store different predetermined operational settings that correspond to each of the plurality of different types of accessories, wherein the stored different predetermined operational settings each include a setting of a speed of the motor and a setting of a heat of the heater, an accessory detection assembly having at least one switch and at least one push rod configured to translate axially relative to a direction of the heated air supplied by the air outlet to engage the at least one switch, and a controller configured to:

once the hair dryer is activated, and with the hair dryer removably mated with the selected one of the plurality of different types of accessories, receive an electrical signal generated by the at least one switch, determine, based on the received electrical signal, a type of the selected one of the plurality of different types of accessories, wherein the electrical signal is unique to the selected one of the plurality of different types of accessories to allow the controller to determine the type of the selected one of the plurality of different types of accessories from among the plurality of different types of accessories, retrieve, from the memory and based on the determined type of the one of the plurality of different types of accessories, the predetermined operational setting corresponding to the determined type of the selected one of the plurality of different types of accessories, and with the hair dryer removably mated with the selected one of the plurality of different types of accessories, execute the retrieved predetermined operational setting.

22. The hair dryer system of claim 21, wherein:

the hair dryer further comprises:

an alignment mechanism configured to align at least one of the plurality of different types of accessories in at least one predetermined rotational orientation relative to the hair dryer, and wherein the at least one push rod of the accessory detection assembly is configured to move to one of a plurality of predetermined structural configurations based on which one of the plurality of different types of accessories is removably mated with and retained by the hair dryer; and the at least one predetermined rotational orientation comprises either:

only one predetermined rotational orientation, or a plurality of predetermined rotational orientations.

23. The hair dryer system of claim 21, wherein the at least one push rod of the accessory detection assembly comprises a plurality of push rods;

each of the plurality of different types of accessories includes a collar each configured to push a different combination of the plurality of push rods; and the electrical signal is in dependence on the combination of the plurality of push rods pushed by the selected one of the plurality of different types of accessories.

* * * * *